US006155780A

United States Patent [19]

Rouse

[11] Patent Number: 6,155,780

[45] Date of Patent: Dec. 5, 2000

[54] CERAMIC RADIAL FLOW TURBINE HEAT SHIELD WITH TURBINE TIP SEAL

[75] Inventor: Gregory C. Rouse, Los Angeles, Calif.

[73] Assignee: Capstone Turbine Corporation, Woodland Hills, Calif.

[21] Appl. No.: 09/374,916

[22] Filed: Aug. 13, 1999

[51] Int. Cl.[7] ..... F01D 11/08

[52] U.S. Cl. ..... 415/173.3; 415/173.4; 415/173.6; 415/178

[58] Field of Search ..... 415/173.3, 173.4, 415/173.6, 178; 417/407; 60/39.75

[56] References Cited

U.S. PATENT DOCUMENTS

| | | | |
|---|---|---|---|
| 4,460,313 | 7/1984 | Austrem . | |
| 4,522,559 | 6/1985 | Burge et al. . | |
| 4,596,116 | 6/1986 | Mandet et al. . | |
| 4,613,288 | 9/1986 | McInerney | 417/407 |
| 5,083,424 | 1/1992 | Becker | 60/39.31 |
| 5,297,928 | 3/1994 | Imakire et al. . | |
| 5,630,702 | 5/1997 | Marmillac et al. . | |
| 5,855,112 | 1/1999 | Bannai et al. | 60/39.511 |

FOREIGN PATENT DOCUMENTS 2271814 4/1994 United Kingdom .

*Primary Examiner*—Edward K. Look
*Assistant Examiner*—Ninh Nguyen
*Attorney, Agent, or Firm*—Brooks & Bushman P.C.

[57] ABSTRACT

A turbine engine includes a rotatable turbine having a peripheral tip and a backface. A heat shield is positioned adjacent the backface and includes an integral ring extending from a peripheral edge of the heat shield to a position spaced radially outwardly from the peripheral tip of the rotatable turbine to form a tip clearance between the ring and the peripheral tip. The turbine comprises a material having a coefficient of thermal expansion at least approximately four times greater than the coefficient of thermal expansion of the heat shield such that the turbine expands toward the ring as a result of heat within the engine, thereby reducing the tip clearance to minimize air flow along the backface and improve efficiency of the engine.

10 Claims, 3 Drawing Sheets

CERAMIC RADIAL FLOW TURBINE HEAT SHIELD WITH TURBINE TIP SEAL

TECHNICAL FIELD

The present invention relates to a turbine engine having a turbine and a ceramic heat shield with a ring forming a tip clearance between the ring and the peripheral tip of the turbine.

BACKGROUND ART

Modern gas turbine engines can be extremely compact, with temperature sensitive components such as turbine rotor bearings placed in close proximity to the turbine section in some designs. This has necessitated the use of shielding for protection, which shielding is positioned between the hot combustion gases and the critical components.

Also, in a high performance gas turbine engine, it is of prime importance that the heat shield maintain a minimal clearance from the turbine impeller to minimize flow of heated air behind the backface of the turbine, which adversely affects efficiency of the engine. Typical flat heat shields positioned adjacent the backface of the turbine require substantial spacing from the turbine as a result of "flowering" or "bending" of the turbine tip during engine operation. Spacing of up to 0.90 inch may be required to allow space for such flowering as well as axial movement of the turbine. This spacing results in substantial airflow along the backface of the impeller, thereby adversely affecting engine efficiency.

For example, in a prior art radial inflow turbine engine such as that shown in FIG. 2, a heat shield is implemented. The heat shield 3 is positioned against the backface 4 of the rotatable turbine 5. The heat shield 3 may be flat or contoured to match the backface 4 of the turbine rotor. The shroud 6 and turbine tip 7 cooperate to form a tip clearance gap 8 which is approximately 0.020 inch. This gap 8 allows flow of heated air along the backface 4 of the turbine 5, which causes losses in efficiency.

It is therefore desirable to provide a heat shield for a turbine engine which efficiently shields sensitive components while minimizing flow of air along the backface of the turbine.

DISCLOSURE OF INVENTION

The present invention provides a heat shield having a peripheral ring which is spaced radially from the peripheral tip of a turbine to form a tip clearance. The turbine and heat shield have differing coefficients of thermal expansion such that the tip clearance is reduced when the engine heats up. This reduced tip clearance minimizes flow along the backface of the turbine, which improves turbine efficiency.

More specifically, the present invention provides a turbine engine including a rotatable turbine having a peripheral tip and a backface. A heat shield is positioned adjacent the backface and includes an integral ring extending from a peripheral edge of the heat shield to a position spaced radially outwardly from the peripheral tip of the rotatable turbine to form a tip clearance between the ring and the peripheral tip. The turbine comprises a material having a coefficient of thermal expansion at least approximately four times greater than the coefficient of thermal expansion of the heat shield such that the turbine expands toward the ring as a result of heat within the engine, thereby reducing the tip clearance to minimize air flow along the backface and improve efficiency of the engine.

Preferably, the heat shield is a ceramic component such as silicon nitride, and the rotatable turbine is a metal component, such as a nickel-based superalloy.

Objects, features and advantages of the present invention will be readily apparent from the following detailed description of the best mode for carrying out the invention when taken in connection with the accompanying drawings.

BEST MODES FOR CARRYING OUT THE INVENTION

Figure 1:
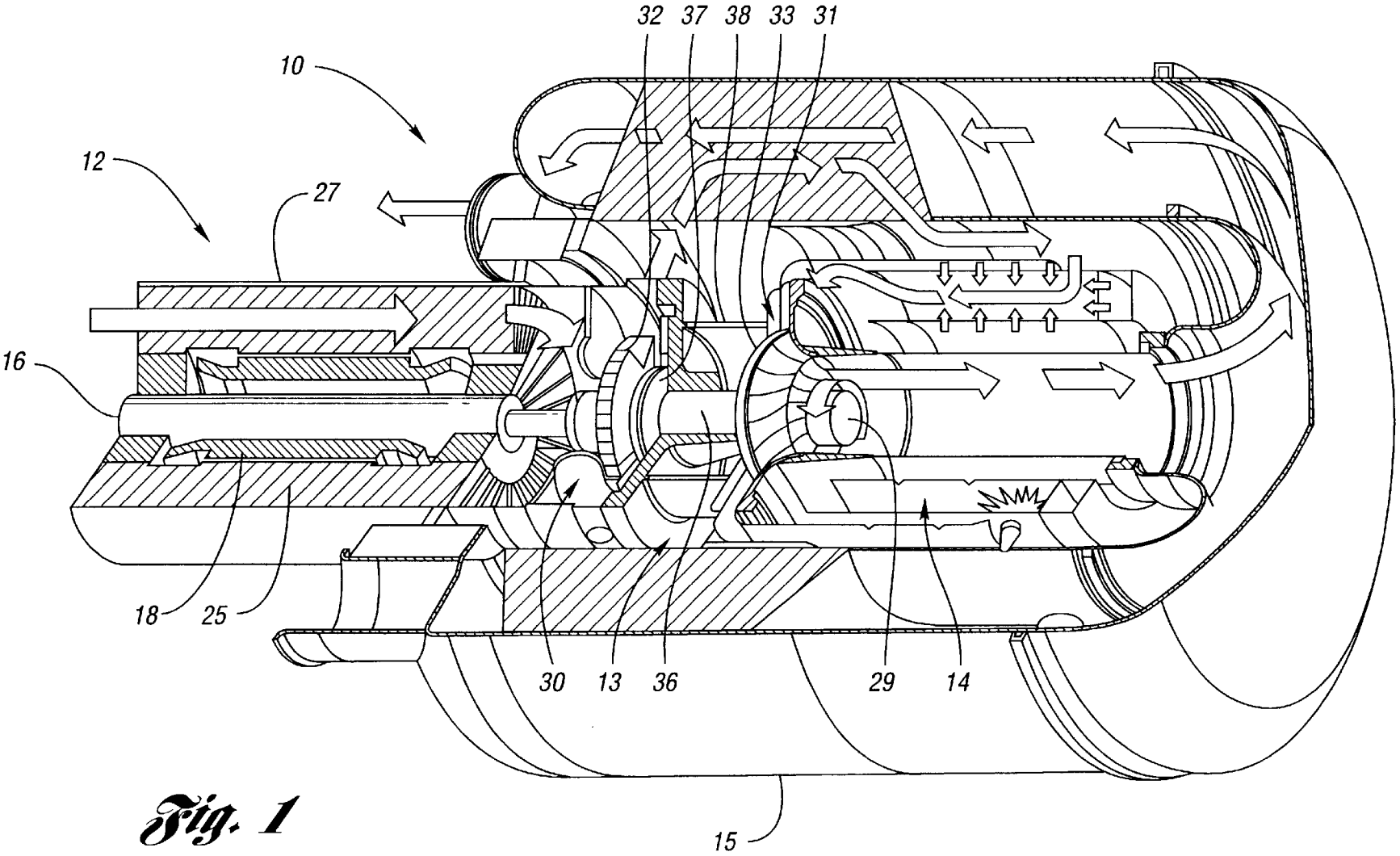
FIG. 1 shows a cut-away perspective view of a turbine engine for use with the present invention.
Figure 2:
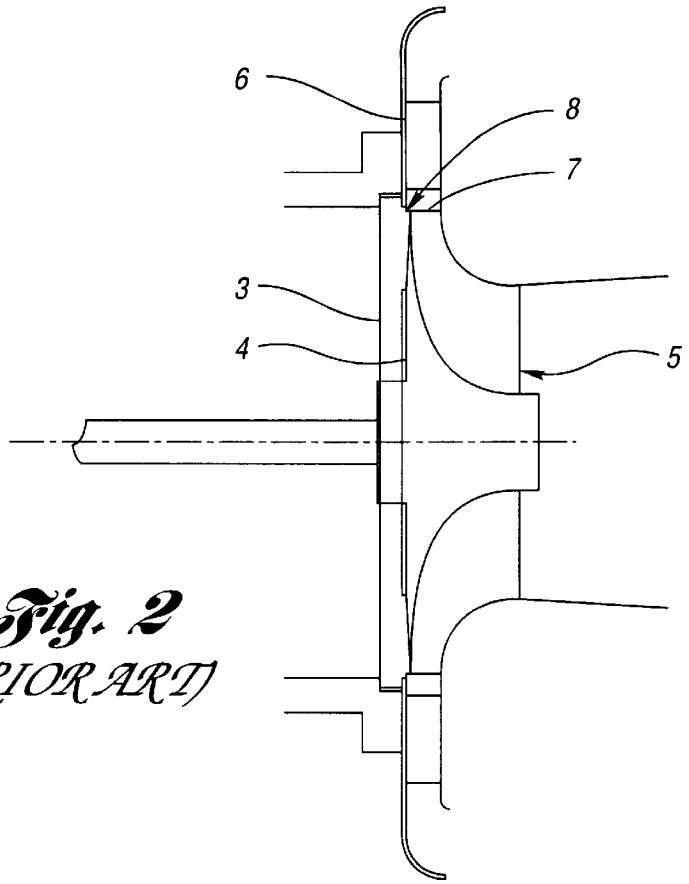
Fig. 2 (PRIOR ART)
FIG. 2 shows a cut-away vertical cross-sectional view of a prior art heat shield in a typical radial inflow turbine engine.

A permanent magnet turbine generator/motor 10 is illustrated in FIG. 1 as an example of a turbine engine in which the heat shield of the present invention could be implemented. The permanent magnet turbine generator/motor 10 generally comprises a permanent magnet generator 12, a power head 13, a combustor 14 and a recuperator (or heat exchanger) 15.

The permanent magnet generator 12 includes a permanent magnet rotor or sleeve 16, having a permanent magnet disposed therein, rotatably supported within a permanent magnet generator stator 18 by a pair of spaced journal bearings. Radial permanent magnet stator cooling fins 25 are enclosed in an outer cylindrical sleeve 27 to form an annular air flow passage which cools the stator 18 and thereby preheats the air passing through on its way to the power head 13.

The power head 13 of the permanent magnet turbo generator/motor 10 includes compressor 30, turbine 31, and bearing rotor 36 through which the tie rod 29 passes. The turbine 31 drives the compressor 30, which includes a compressor impeller or wheel 32 which receives preheated air from the annular air flow passage in cylindrical sleeve 27 around the permanent magnet stator 18. The turbine 31 includes a turbine wheel 33 which receives heated exhaust gasses from the combustor 14 supplied with air from recuperator 15. The compressor wheel 32 and turbine wheel 33 are rotatably supported by bearing shaft or rotor 36 having a radially extending bearing rotor thrust disk 37. The bearing rotor 36 is rotatably supported by a single journal bearing within the center bearing housing 38 while the bearing rotor thrust disk 37 at the compressor end of the bearing rotor 36 is rotatably supported by a bilateral thrust bearing. The bearing rotor thrust disk 37 is adjacent to the thrust face at the compressor end of the center bearing housing while a bearing thrust plate is disposed on the opposite side of the bearing rotor thrust disk 37 relative to the center housing thrust face.

Intake air is drawn through the permanent magnet generator by the compressor 30 which increases the pressure of the air and forces it into the recuperator 15. In the recuperator 15, exhaust heat from the turbine 31 is used to preheat the air before it enters the combustor 14 where the preheated air is mixed with fuel and burned. The combustion gases are then expanded in the turbine 31 which drives the compressor 30 and the permanent magnet rotor 16 of the permanent magnet generator 12 which is mounted on the same shaft as the turbine 31. The expanded turbine exhaust gasses are then passed through the recuperator 15 before being discharged from the turbo generator/motor 10.

The present invention is designed for use with a turbine engine such as that described above with reference to FIG. 1, however the present invention is not limited to such an application. The invention is particularly useful for radial inflow turbine engines, but may be adapted for use with other turbine engines.

In particular, the present invention relates to a heat shield which is positioned adjacent the backface of a turbine, such as the turbine 31 shown in FIG. 1, to prevent heat from affecting sensitive components at the compressor side of the turbine 31, and also to enhance engine efficiency by preventing heat loss along the backface of the turbine 31. The invention is more clearly understood with reference to FIGS. 3 and 4. As illustrated, the heat shield 40 of the present invention has a circumferential ring 42 extending from a peripheral edge 44 of the heat shield 40. Preferably, the ring 42 is cast with the heat shield 40 as a single component. The heat shield 40 also includes an aperture 46 formed therein to receive the bearing rotor 36, illustrated in FIG. 1. Preferably, the heat shield 40 is mounted to the center bearing housing 38, also illustrated in FIG. 1.

Figure 4:
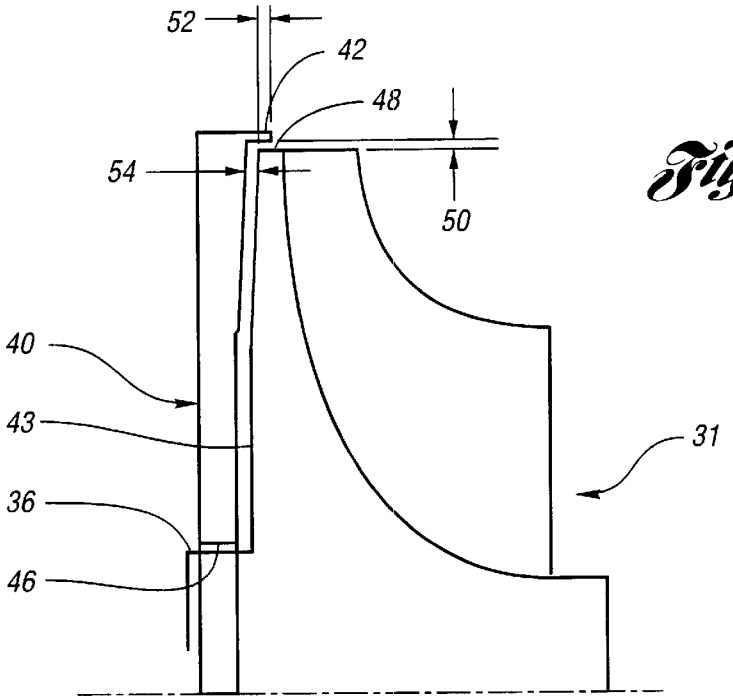
FIG. 4 shows a partial vertical cross-sectional view of a heat shield and turbine in accordance with the present invention.

As illustrated in FIG. 4, the ring 42 of the heat shield 40 cooperates with the peripheral tip 48 of the turbine 31 to form a tip clearance 50 along the length of the overlap 52 between the ring 42 and the peripheral tip 48. Also, a backface clearance 54 is provided between the heat shield 40 and the backface 43 of the turbine 31. The backface 43 is tapered near the tip, as shown, to correspond with the taper of the heat shield. Alternatively, these components may be flat or contoured to minimize turbine rotor stresses.

The turbine 31 is preferably a nickel-based superalloy having a coefficient of thermal expansion between approximately $5.92\times10^{-6}$ in/in/° F. and $9.89\times10^{-6}$ in/in/° F. Also, the heat shield 40 is preferably a silicon nitride (ceramic) component having a coefficient of thermal expansion between 0 and $1.37\times10^{-6}$ in/in/° F. In this configuration, engine heat causes expansion of the turbine 31 and heat shield 40. Because of the differing coefficients of thermal expansion, the turbine 31 expands at a substantially greater rate than the heat shield 40, thereby reducing the tip clearance 50 to as little as approximately 0.005 inch.

This minimized tip clearance 50 improves efficiency of the engine because substantial air flow through the gap 50 and along the backface 43 of the turbine 31 is eliminated, thereby preventing unnecessary turbine engine efficiency losses which would result from the loss of heat behind the turbine. The backface clearance 54 provides sufficient room for "flowering" of the turbine tip 48 as well as for axial movement of the turbine 31 in operation. Since the turbine 31 comprises a material having a coefficient of thermal expansion which is at least approximately four times greater than the coefficient of thermal expansion of the heat shield, the tip clearance 50 is more predictable and easier to control in comparison with an all-metal design, in which thermal gradients would significantly affect thermal expansion of different areas of the part, thereby reducing predictability. Because the coefficient of expansion of ceramic is comparatively low, greater control of the tip clearance is provided.

Also, as a result of the improved tip clearance 50 control, the backface clearance 54 is not as critical because it is not the limiting factor preventing flow along the backface of the turbine. Accordingly, backface clearance need not be tightly controlled, thereby easing manufacture.

Figure 3A:
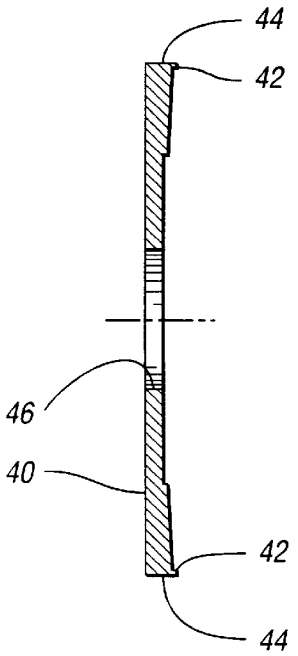
FIG. 3*a* shows a partial vertical cross-sectional view of the heat shield in accordance with the present invention.
Figure 3B:
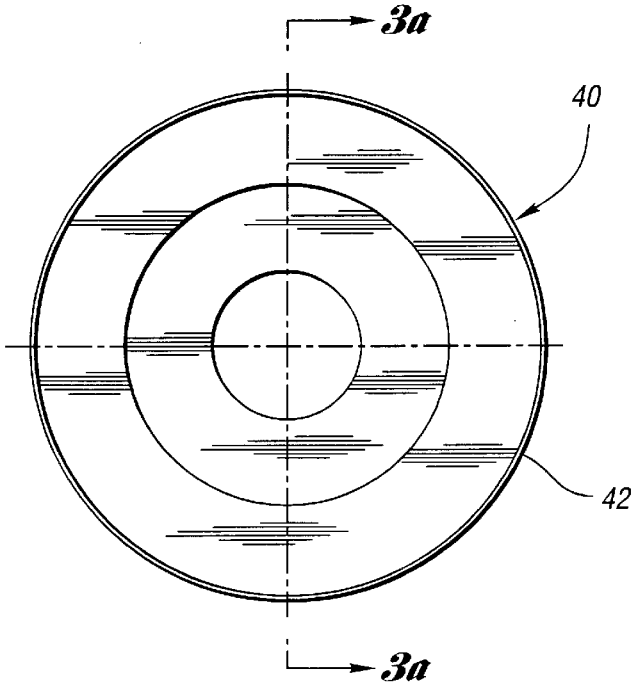
FIG. 3*b* shows a plan view of the heat shield of FIG. 3*a;*
Figure 5:
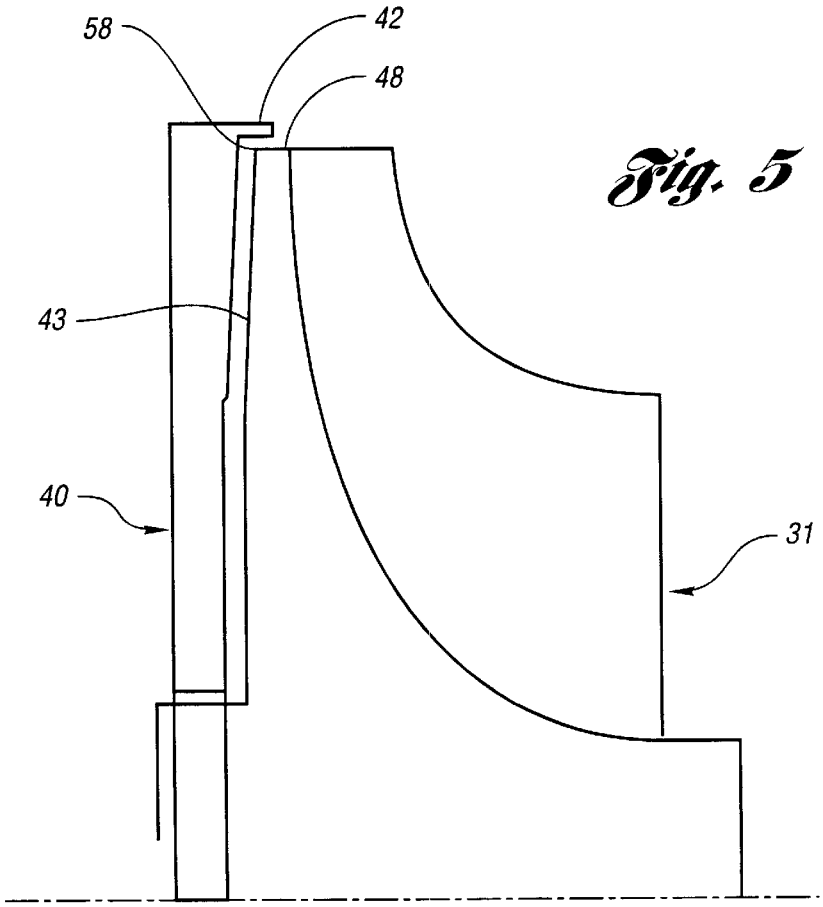
FIG. 5 shows a partial vertical cross-sectional view of a turbine engine in accordance with an alternative embodiment of the invention.

Referring to FIG. 5, an alternative embodiment of the invention is shown which is in all other respects identical to that of FIGS. 3 and 4 except that the turbine tip 48 includes an integral knife edge 58 in a position aligned with the backface 43 of the turbine 31. This knife edge 58 extends radially about the periphery of the turbine 31. The knife edge 58 is allowed to rub against the internal diameter of the ceramic ring 42 when the turbine 31 expands as a result of heat during engine operation, thereby creating an extremely small tip clearance from the ring 42, and further improving efficiency of the engine.

While the best modes for carrying out the invention have been described in detail, those familiar with the art to which this invention relates will recognize various alternative designs and embodiments for practicing the invention within the scope of the appended claims.

What is claimed is:

1. A turbine engine comprising:

a rotatable turbine having a peripheral tip and backface; and a heat shield positioned adjacent said backface and including an integral ring extending from a peripheral edge of the heat shield to a position spaced radially outwardly from the peripheral tip of the rotatable turbine to form a tip clearance between the ring and the peripheral tip;

wherein said turbine comprises a material having a coefficient of thermal expansion at least approximately four times greater than the coefficient of thermal expansion of the heat shield such that the turbine expands more than the ring as a result of heat within the engine, thereby reducing the tip clearance to minimize air flow along the backface and improve efficiency of the engine.

2. The turbine engine of claim 1, wherein said heat shield comprises a ceramic, and said rotatable turbine comprises a metal.

3. The turbine engine of claim 2, wherein said ceramic comprises silicon nitride and said metal comprises a nickel-based alloy.

4. The turbine engine of claim 1, wherein said heat shield comprises a material having a coefficient of thermal expansion between approximately $1.4\times10^{-6}$ in/in/° F. and 0 in/in/° F. and said rotatable turbine comprises a material having a coefficient of thermal expansion between approximately $9.9\times10^{-6}$ in/in/° F. and $5.9\times10^{-6}$ in/in/° F.

5. The turbine engine of claim 1, wherein said rotatable turbine includes a knife edge extending radially outwardly from the peripheral tip to rub against the ring when the turbine expands as a result of engine heat.

6. A radial inflow turbine engine comprising:

a rotatable turbine having a peripheral tip and a backface, the rotatable turbine being configured to receive heated air flowing radially inwardly toward the turbine and to redirect the heated air axially; and a heat shield positioned adjacent said backface and including an integral ring extending from a peripheral edge of the heat shield to a position spaced radially outwardly from the peripheral tip of the rotatable turbine along the entire peripheral tip to form a tip clearance between the ring and the peripheral tip;

wherein said turbine comprises a metal material and said heat shield comprises a ceramic material such that the turbine expands more than the ring as a result of heat within the engine, thereby reducing the tip clearance to discourage flow of said heated air along the backface and improving efficiency of the engine.

7. The turbine engine of claim 6, wherein said ceramic comprises silicon nitride and said metal comprises a nickel based alloy.

8. The turbine engine of claim 6, wherein said heat shield comprises a material having a coefficient of thermal expansion between approximately $1.4\times10^{-6}$ in/in/° F. and 0 in/in/° F., and said rotatable turbine comprises a material having a coefficient of thermal expansion between approximately $9.9\times10^{-6}$ in/in/° F. and $5.9\times10^{-6}$ in/in/° F.

9. The turbine engine of claim 6, wherein said rotatable turbine includes a knife edge extending radially outward from the peripheral tip to rub against the ring when the turbine expands toward the ring under heat.

10. A radial inflow turbine engine comprising:

a rotatable turbine having a peripheral tip and a backface;

a heat shield positioned adjacent said backface and including an integral ring extending from a peripheral edge of the heat shield to a position spaced radially outwardly from the peripheral tip of the rotatable turbine to form a tip clearance between the ring and the peripheral tip;

wherein said turbine and heat shield comprise materials having sufficiently different coefficients of thermal expansion such that the turbine expands significantly more than the heat shield as a result of engine heat, thereby reducing the tip clearance to minimize airflow along the backface and improve efficiency of the engine.

* * * * *